US010012018B1

(12) United States Patent
Plummer

(10) Patent No.: US 10,012,018 B1
(45) Date of Patent: Jul. 3, 2018

(54) DUAL SUPPORT CONNECTOR ASSEMBLY

(71) Applicant: John B. Plummer, Houston, TX (US)

(72) Inventor: John B. Plummer, Houston, TX (US)

( * ) Notice: Subject to any disclaimer, the term of this patent is extended or adjusted under 35 U.S.C. 154(b) by 0 days.

(21) Appl. No.: 15/713,287

(22) Filed: Sep. 22, 2017

(51) Int. Cl.
*E06B 3/58* (2006.01)
*E06B 3/64* (2006.01)
*E06B 3/54* (2006.01)
*E06B 5/12* (2006.01)

(52) U.S. Cl.
CPC ..... *E06B 3/5892* (2013.01); *E06B 3/5481* (2013.01); *E06B 3/645* (2013.01); *E06B 5/12* (2013.01)

(58) Field of Classification Search
CPC ..... E06B 3/5892; E06B 3/645; E06B 3/5481; E06B 5/12
See application file for complete search history.

(56) References Cited

U.S. PATENT DOCUMENTS 3,760,543 A * 9/1973 McAllister ..... E06B 3/5892 52/204.591
4,930,276 A * 6/1990 Bawa ..... E06B 5/162 52/208
5,105,597 A * 4/1992 Wilkening ..... E06B 3/5892 52/455
8,359,796 B1 * 1/2013 Plummer ..... E06B 3/5892 52/204.61
8,434,284 B1 * 5/2013 Plummer ..... E06B 3/5892 52/745.16
9,562,389 B2 * 2/2017 Badger ..... E06B 3/5892
2003/0066256 A1 * 4/2003 DeBlock ..... B32B 17/10 52/208
2004/0226233 A1 * 11/2004 LaSee ..... E06B 3/5892 52/204.5
2007/0193140 A1 * 8/2007 Carnick ..... E06B 3/5892 52/208
2008/0209826 A1 * 9/2008 Hodges ..... E06B 3/5892 52/204.7

FOREIGN PATENT DOCUMENTS

GB 2463267 B 3/2010

* cited by examiner

*Primary Examiner* — Jeanette E Chapman
(74) *Attorney, Agent, or Firm* — Buskop Law Group, P.C.; Wendy Buskop

(57) ABSTRACT

A dual support connector assembly has a clip body with a pair of through hole, a door flange extending from the clip body; a glass flange extending from the clip body in parallel with the door flange, a fixed sealing frame, a seal-less removable frame for attaching to the dual support connector assembly on an opposite side of the fixed sealing frame, and a fastener engaging the attachment clip to the fixed sealing frame.

12 Claims, 7 Drawing Sheets

DUAL SUPPORT CONNECTOR ASSEMBLY

CROSS REFERENCE TO RELATED APPLICATIONS

The present application claims a priority to U.S. Provisional Patent Application Ser. No. 62/477,077 filed on Mar. 27, 2017, for "Door Assembly with Dual Support Connector Assembly" and U.S. Provisional Patent Application Ser. No. 62/477,258 filed on Mar. 27, 2017, for "Carved High Strength Door." These references are hereby incorporated in their entirety.

FIELD

The present embodiment generally relates to a dual support connector assembly.

BACKGROUND

A need exists for a dual support connector assembly that does not put holes in an insert frame that mounts the glass panel into the door assembly.

The present embodiments meet these needs.

Figure 1:
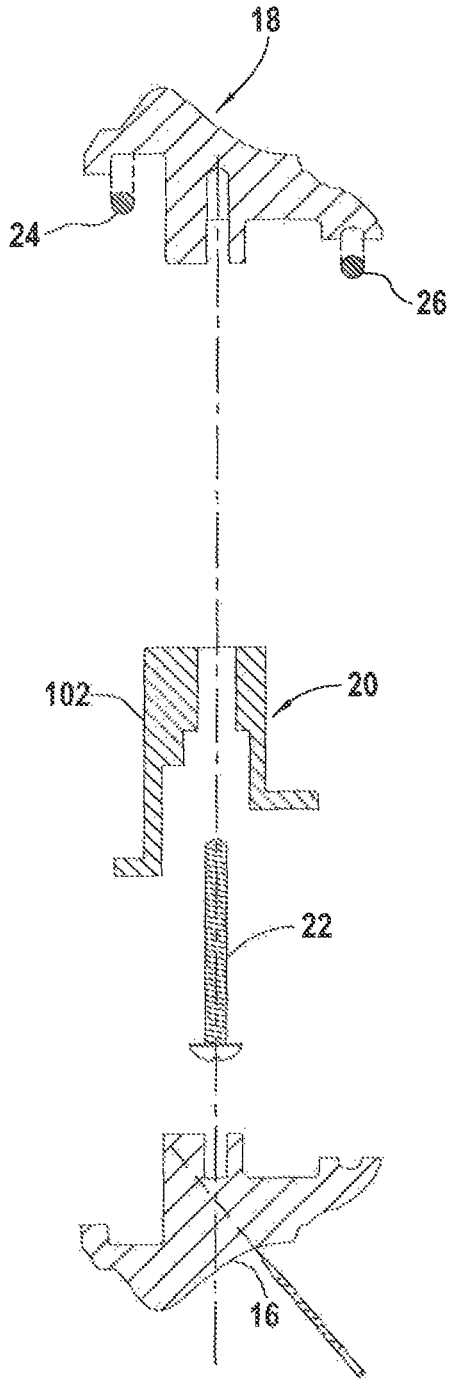
FIG. 1 depicts an exploded view of a dual support connector according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention relates to a dual support connector assembly positioned between a door panel and a glass panel for a door assembly.

The dual support connector assembly can have a clip body 102 having a pair of through holes.

A door flange 98 extends from the clip body 102;

In embodiments, a glass flange can extend from the clip body 102 in parallel with the door flange.

A fixed sealing frame 18 can engage the dual support connector assembly;

The dual support connector assembly can have a first seal between the door panel and the fixed sealing frame 18 for sealing the fixed sealing frame 18 to the door panel.

A second seal can be between the glass panel and the fixed sealing frame 18 for sealing the fixed sealing frame 18 to the glass panel.

In embodiments, fastener engages the clip body 102 to the fixed sealing frame 18.

The dual support connector assembly can have a plurality of compression brads each penetrating the seal-less removable frame 16 and clip body 102 at an angle between 10 and 90 degrees, in a spaced apart relationship.

The improved dual support connector assembly secures between a fixed sealing frame 18, door panel and glass panel and the seal-less removable frame 16 opposite side of the fixed sealing frame 18 without touching the seal-less removable frame 16.

The embodiments provide secure connection, which prevents a door or glass pane from breaking during severe weather, such as a hurricane.

The embodiments, allow the glass panel to be easily removable for cleaning purposes.

Now turning to the Figures, FIG. 1 is an exploded view of the dual support connector assembly according to one or more embodiments.

The dual support connector 20 is shown.

In embodiments, the dual support connector assembly 20 is positioned between a door panel and a glass panel.

The dual support connector assembly includes a fixed sealing frame 18. The fixed sealing frame 18 engages the dual support connector assembly 20.

In embodiments, the dual support connector assembly has a seal-less removable frame 16. The seal-less removable frame 16 attaches to the dual support connector assembly 20 on an opposite side of the door panel and glass panel from the fixed sealing frame 18 as shown in FIG. 2.

A fastener 22 engages the dual support connector assembly 20 to the fixed sealing frame 18.

Figure 2:
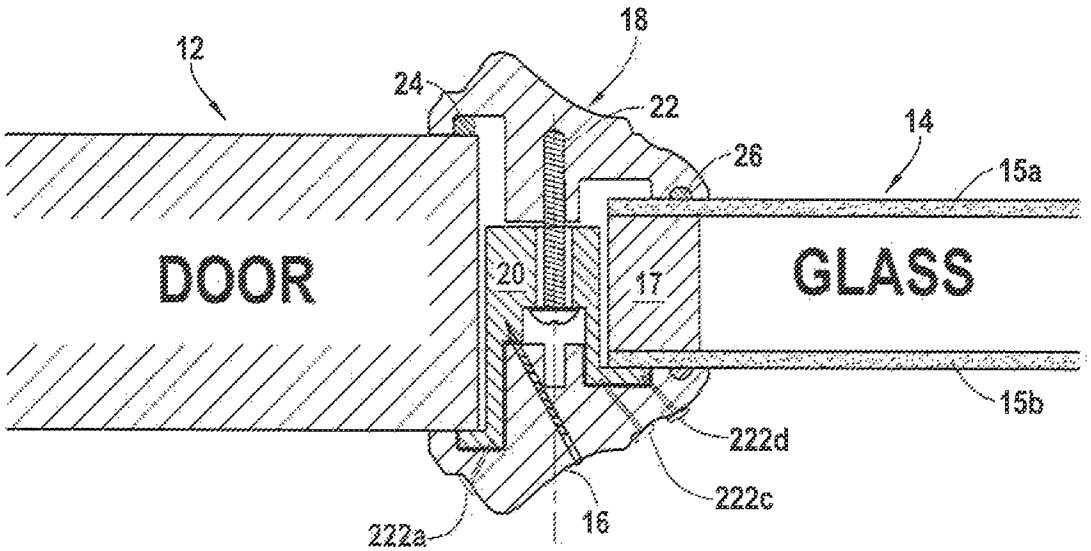
FIG. 2 depicts an assembled view of the elements of the dual support connector according to one or more embodiments.

The door assembly with the dual support connector has a first seal 24 between the door panel and the fixed sealing frame 18 as shown in FIG. 2.

The door assembly with the dual support connector has a second seal 26 between the glass panel and the fixed sealing frame 18 as shown in FIG. 2.

In embodiments, the dual support connector 20 has a plurality of compression brads 222*a*-222*d*. Each compression brad penetrates the seal-less removable frame 16 and clip body 102 at an angle between 10 degrees and 90 degrees in a spaced apart relationship.

FIG. 2 depicts an assembled view of the elements of the dual support connector assembly according to one or more embodiments.

The dual support connector has a door panel 12 and a glass panel 14 attached to the fixed sealing frame 18 engaging the door panel and the glass panel.

In embodiments, the dual support connector 20 has a seal-less removable frame 16. The seal-less removable frame 16 attaches to the dual support connector assembly 20 on an opposite side of the door panel 12 and glass panel 14 from the fixed sealing frame 18.

The glass panel can have a plurality of glass panes 15*a* and 15*b* separated by a spacer/sealant 17.

The fixed sealing frame 18 is engaged with the dual support connector assembly 20 via fastener 22. The seal-less removable frame 16 has brads 222*a*, 222*b*, 222*c* applying compression to the frame for additional seal pressure.

Figure 3A:
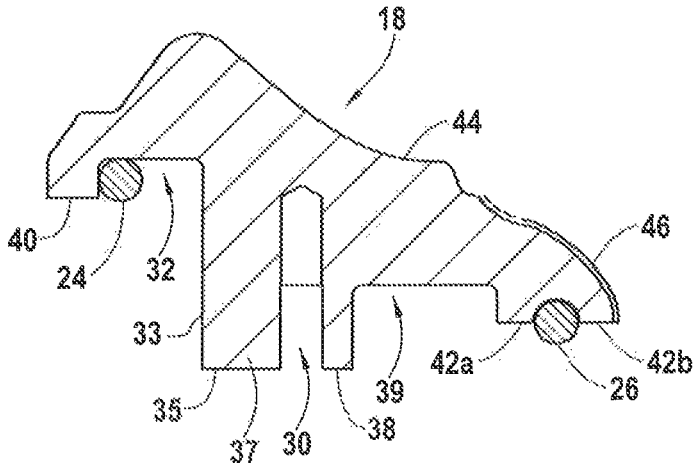
FIG. 3A depicts cross sectional view of the fixed sealing frame 18 according one or more embodiments.

FIG. 3A depicts cross sectional view of the fixed sealing frame 18 according one or more embodiments.

The fixed sealing frame 18 includes a fixed sealing frame profile 44. The fixed sealing frame profile 44 is covered with a coating layer 46.

A door contact surface 40 extends from the fixed sealing frame profile 44.

The fixed sealing frame 18 includes a side flex and sealing gap surface 33. The side flex and sealing gap surface 33 extends from the door contact surface 40.

An upper flex and sealing gap 32 is formed between the door contact surface 40 and the side flex and sealing gap surface 33.

In embodiments, a lower flex and sealing gap surface 35 extends from the side flex and sealing gap surface 33 to form a first channel engagement member 37.

A second channel engagement member 38 is formed in parallel to the first channel engagement member 37 creating a first alignment cavity 30.

A flex gap 39 is formed between the second channel engagement member 38 and a first glass contact surface 42*a*.

In embodiments, a second glass contact surface 42*b* can be formed in parallel to the first glass contact surface 42*a* containing a first seal 24.

A second seal 26 is located between the door contact surface 40 and the side flex and sealing gap surface 33.

In embodiments a textured surface, a smooth surface or a woodgrain surface is formed on the fixed sealing frame profile 44.

In embodiments, a shape for the fixed sealing frame profile 44 is selected from the group consisting of a rectangle, a half round, or a decorative molding shape.

The fixed sealing frame profile 44 can have a coating layer 46. The coating layer 46 can consists of a stain, a paint, a sealant, or a primer coat.

Figure 3B:
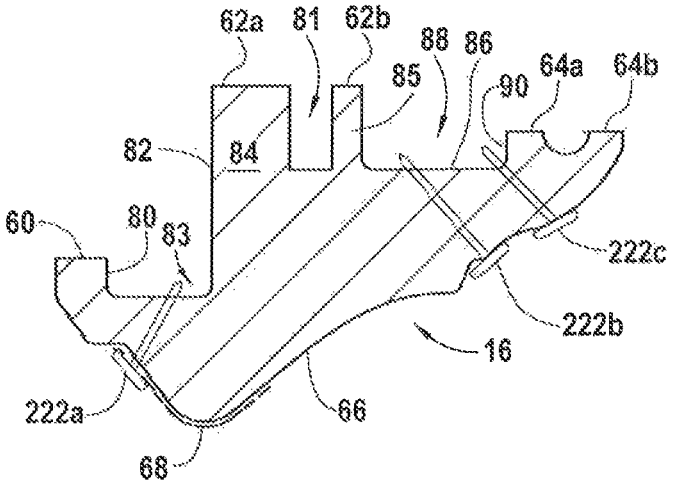
FIG. 3B depicts cross sectional view of the seal-less removable frame 16 according to one or more embodiments.

FIG. 3B depicts cross sectional view of the seal-less removable frame 16 according to one or more embodiments.

The seal-less removable frame 16 includes a seal-less removable frame profile 66 with a paint layer 68.

In embodiments, the seal-less removable frame 16 includes a door contact surface 60. The door contact surface 60 extends from the seal-less removable frame profile 66.

A first side gap surface 80 extends from the door contact surface 60.

A second side gap surface 82 extends from the first side gap surface 80 to form a rigid gap 83.

In embodiments, the seal-less removable frame 16 includes first alignment channel engagement member 84.

A first clip surface 62*a* is formed on the first alignment channel engagement member 84.

In embodiments, the seal-less removable frame 16 includes a second alignment channel engagement member 85.

A second clip surface 62*b* is formed on the second alignment channel engagement member 85 in parallel with the first clip surface 62*a*.

In embodiments, the seal-less removable frame 16 includes a second alignment cavity 81 formed between the first alignment channel engagement member 84 and second alignment channel engagement member 85.

The seal-less removable frame 16 includes a third side gap surface 86 extending from the second clip surface 62*b*.

A rigid gap 88 is formed between the second alignment channel engagement member 85 and a fifth side gap surface 90.

In embodiments, the seal-less removable frame 16 includes a first glass contact surface 64*a*.

A second glass contact surface 64*b* is formed in parallel to the first glass contact surface 64*a* connecting to the seal-less removable frame profile 66.

In embodiments, a textured surface, a smooth surface or a woodgrain surface can be formed on the seal-less removable frame profile 66.

In embodiments, a shape for the seal-less removable frame profile 66 can be selected from the group consisting of a rectangle, a half round, or a decorative molding shape.

The seal-less removable profile can have a coating layer 68. The coating layer 68 that can consists of a stain, a paint, a sealant, or a primer coat.

Figure 4:
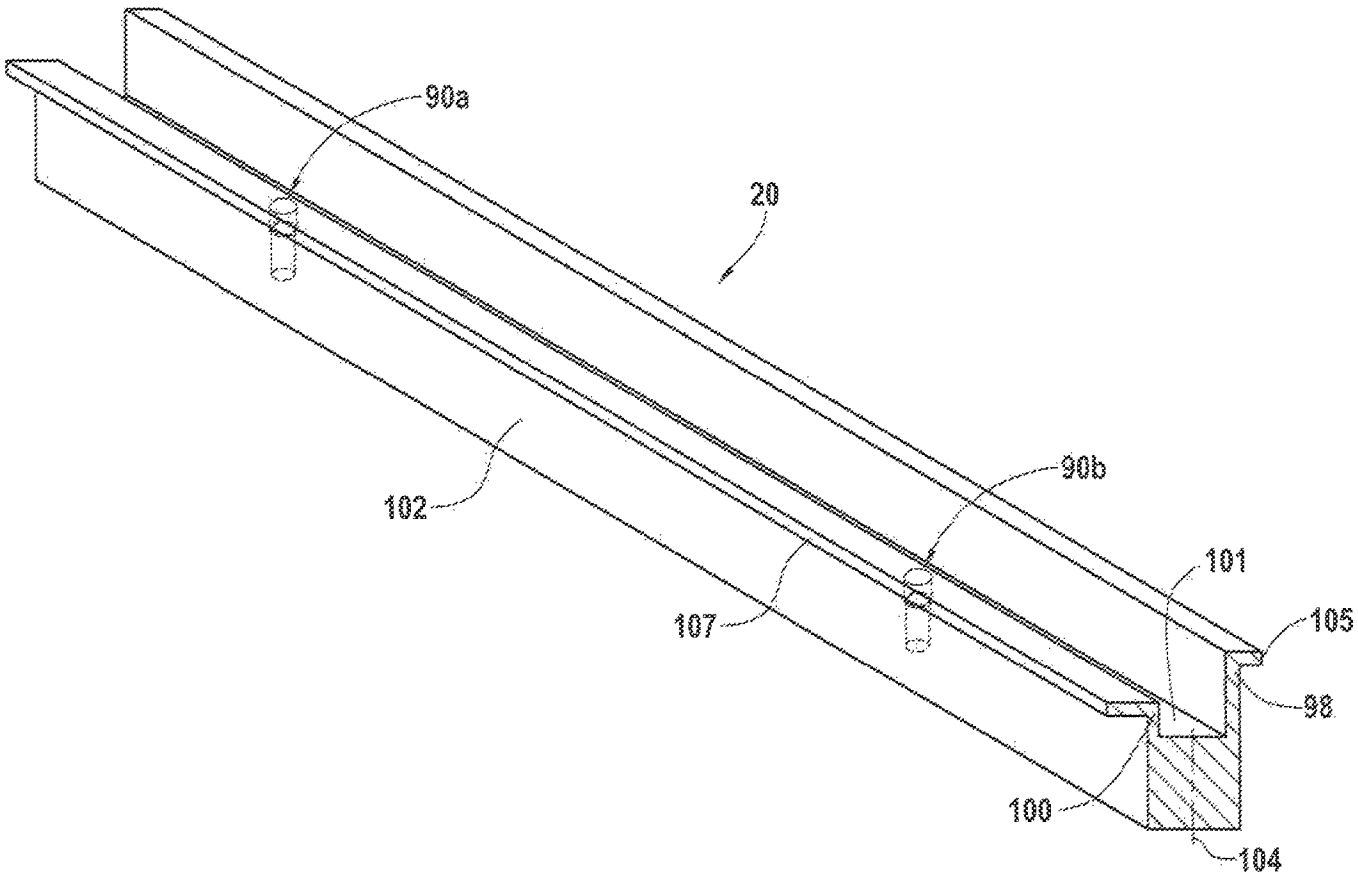
FIG. 4 depicts a perspective view of the dual support connector assembly according to one or more embodiments.

FIG. 4 depicts a perspective view of the dual support connector assembly 20 according to one or more embodiments.

The dual support connector assembly 20 includes a clip body 102. A door flange 98 extends from the clip body 102.

The clip body 102 has a pair of through holes 90*a* and 90*b*.

In embodiments, the door flange 98 includes a door flange lip 105 extending at an angle from 80 degrees to 100 degrees from a central axis 104 of the clip body 102.

A glass flange 100 extends from the clip body 102 in parallel with the door flange 98.

In embodiments, the glass flange 100 includes a glass flange lip 107 extending at an angle from 80 degrees to 100 degrees from a central axis 104 of the clip body 102.

In embodiments, the height of the door flange 98 and the height of the glass flange 100 are unequal.

Figure 5:
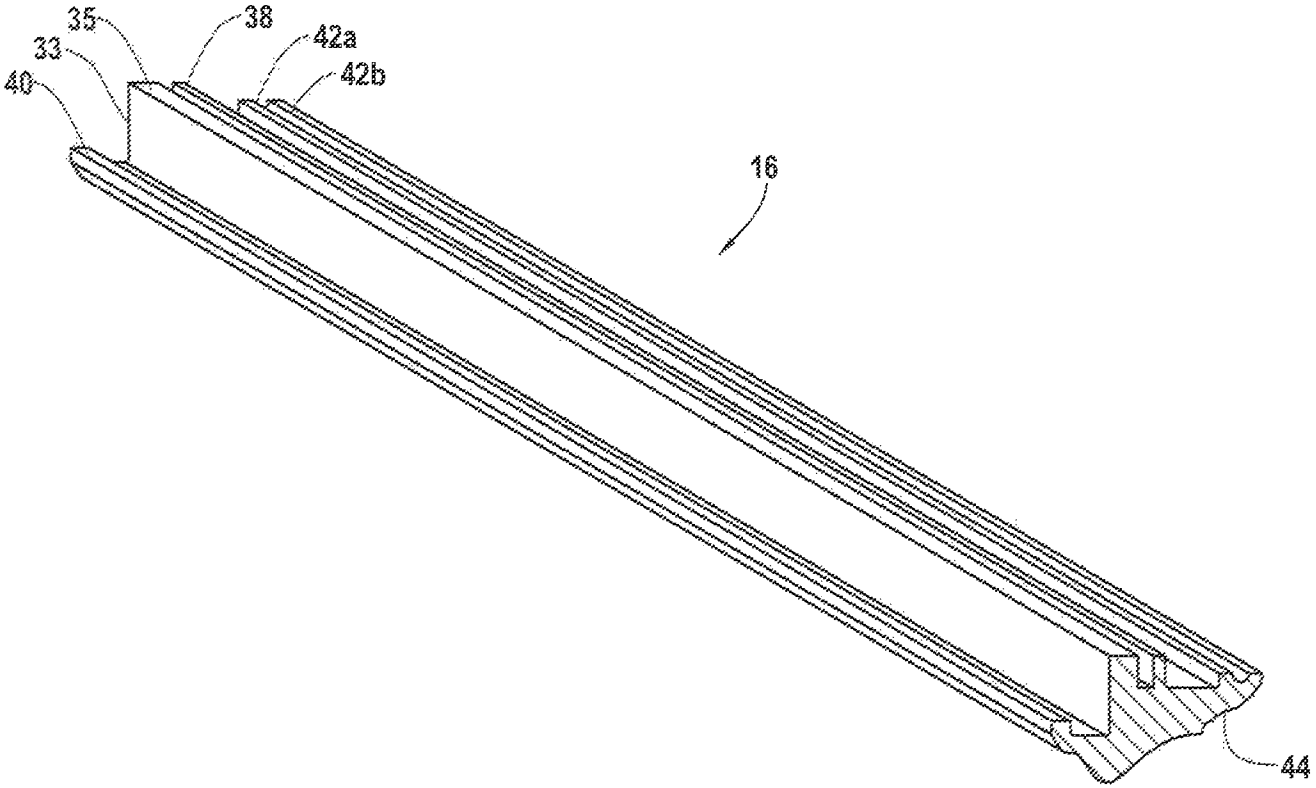
FIG. 5 depicts a perspective view of the fixed sealing frame 18 according to one or more embodiments.

FIG. 5 depicts a perspective view of the fixed sealing frame 18 according to one or more embodiments.

The fixed sealing frame 18 has a door contact surface 40 extending from the fixed sealing frame profile 44.

A lower flex and sealing gap surface 35 extends from the side flex and sealing gap surface 33.

In embodiments, the fixed sealing frame 18 has a second channel engagement member 38 parallel to the lower flex and sealing gap surface 35.

The second channel engagement member 38 is parallel to a first glass contact surface 42*a* and a second glass contact surface 42*b*.

Figure 6:
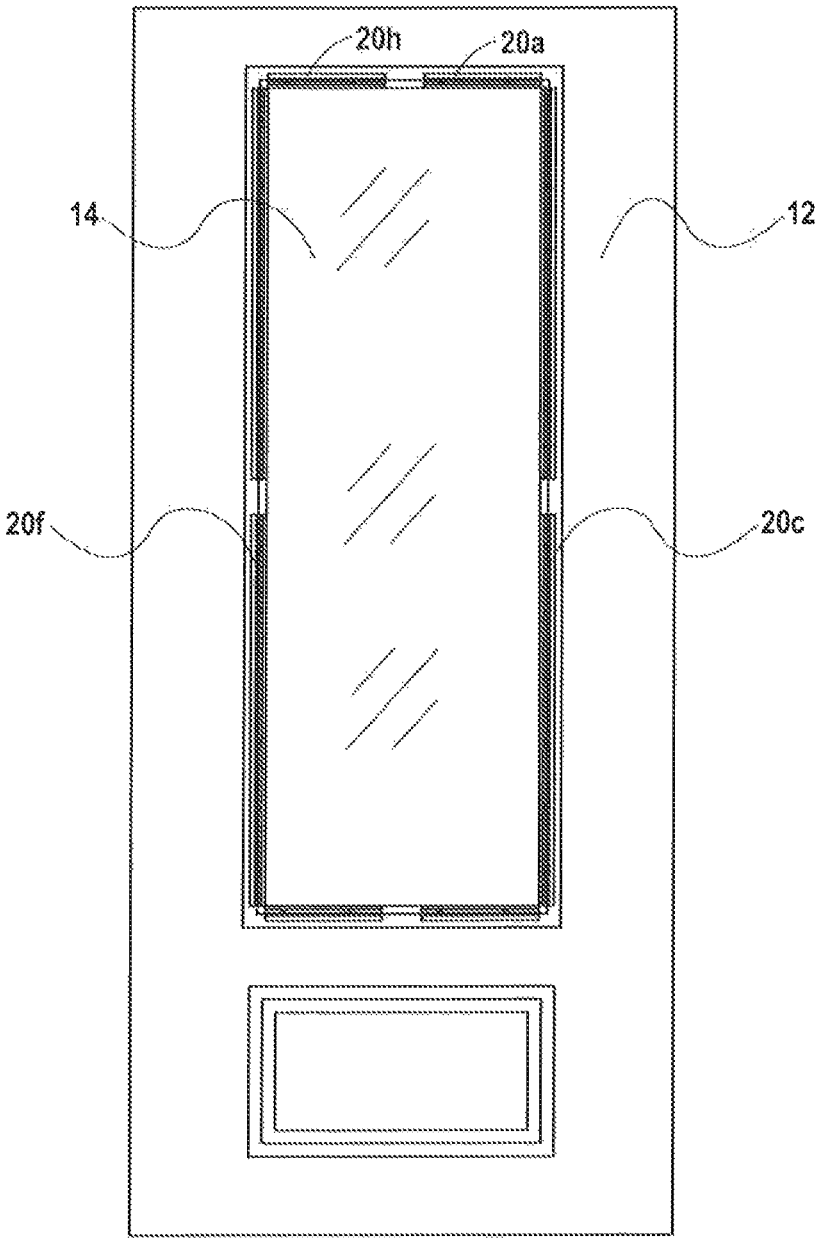
FIG. 6 is a front view of the connectors mounted in the fixed sealing frame 18.

FIG. 6 depicts a front view of a door panel 12 with dual support connector assembly and according to one or more embodiments.

The door is shown with a door panel 12, a glass panel 14, and dual support connector assembly 20*a*-20*h* positioned between the door panel 12 and glass panel 14.

Figure 7:
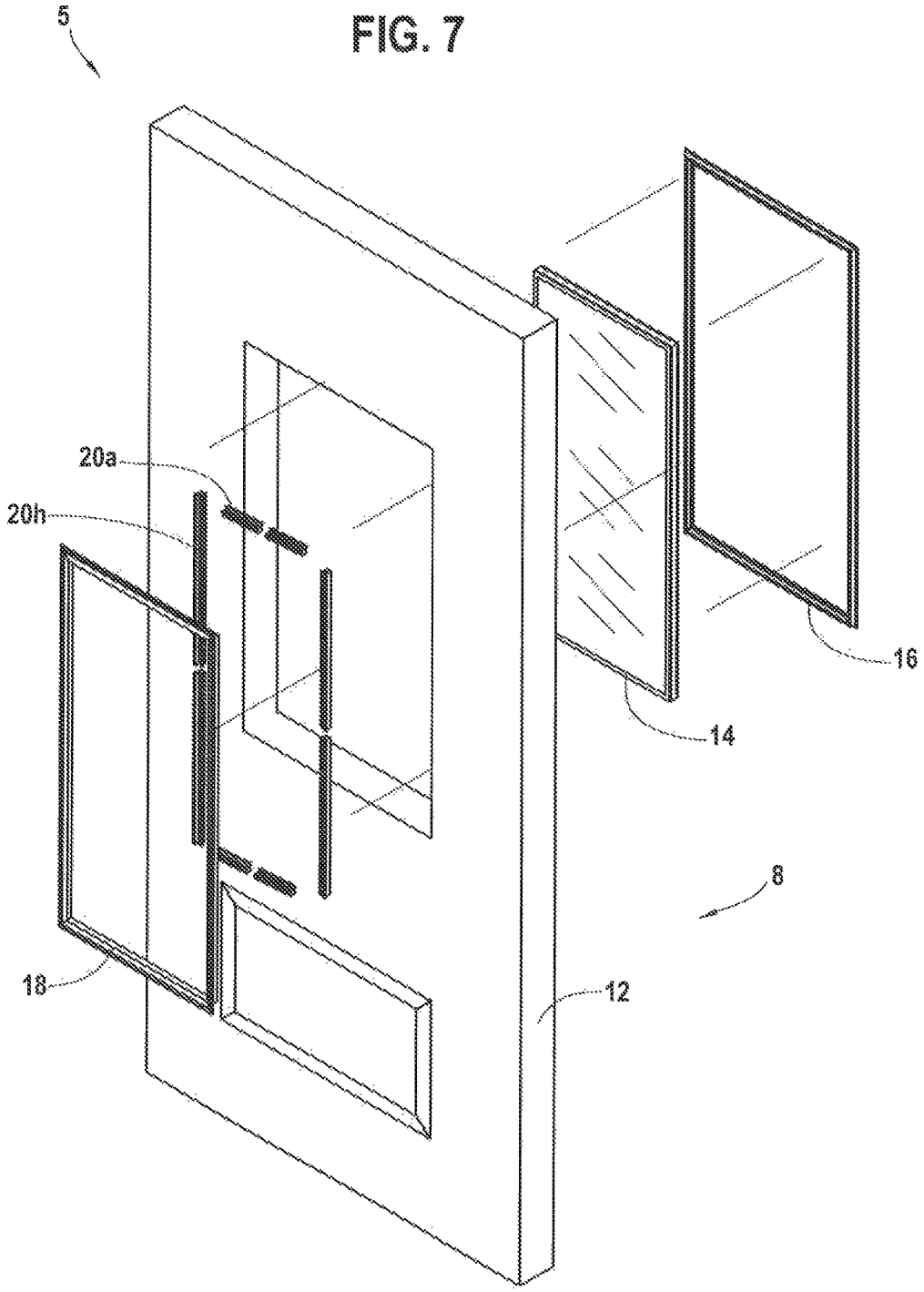
FIG. 7 is an exploded view of the assembly.

FIG. 7 depict and exploded view of a door panel 12 with an embodiment of the dual support connector assembly that omits corner clips according to one or more embodiments.

The door 5 is shown with a door panel 12, a glass panel 14, and dual support connector assembly 20*a*-20*h* positioned between the door panel 12 and glass panel 14.

A fixed sealing frame 18 is shown with a fasteners 22*a*-22*h* for engaging the fixed sealing frame 18 to the dual support connector assembly 20*a*-20*h*.

A seal-less removable frame 16 attaches to the dual support connector assembly 20*a*-20*h* on an opposite side of the door panel 12 and glass panel 14 from the fixed sealing frame 18.

While these embodiments have been described with emphasis on the embodiments, it should be understood that within the scope of the appended claims, the embodiments might be practiced other than as specifically described herein.

What is claimed is:

1. A dual support connector assembly to be positioned between a door panel and a glass panel for a door assembly comprising:

a. a clip body having a pair of through holes and a door flange extending from the clip body, a glass flange extending from the clip body in parallel with the door flange;

b. a fixed sealing frame for engaging the dual support connector assembly;

c. a first seal between the door panel and the fixed sealing frame for sealing the fixed sealing frame to the door panel;

d. a second seal between the glass panel and the fixed sealing frame for sealing the fixed sealing frame to the glass panel;

e. a fastener engaging the clip body to the fixed sealing frame;

f. a seal-less removable frame with a seal-less removable frame profile and g. a plurality of compression brads each penetrating the seal-less removable frame and the clip body without penetrating at least one of: the door panel and the glass panel, each compression brad of the plurality of compression brads penetrating the clip body at an angle between 10 and 90 degrees, in a spaced apart relationship from each other;

wherein the improved dual support connector assembly secures between the fixed sealing frame, the door panel and the glass panel and the seal-less removable frame on an opposite side of the fixed sealing frame without touching the seal-less removable frame creating an easily removable glass panel with a secure connection, during severe weather, including a hurricane.

2. The dual support connector assembly of claim 1, wherein the fixed sealing frame 18 comprises:

a. a fixed sealing frame profile covering the fixed sealing frame profile;

b. a door contact surface extending from the fixed sealing frame profile;

c. a side flex and sealing gap surface extending from the door contact surface forming an upper flex and sealing gap formed between the door contact surface and the side flex and sealing gap surface;

d. a lower flex and sealing gap surface extending from the side flex and sealing gap surface forming a first channel engagement member;

e. a second channel engagement member formed in parallel to the first channel engagement member creating an first alignment cavity;

f. a flex gap formed between the second channel engagement member 38 and a first glass contact surface;

g. a second glass contact surface formed in parallel to the first glass contact surface containing the first seal and extending to the fixed sealing frame profile.

3. The dual support connector assembly of claim 1, comprising a textured surface, a smooth surface or a woodgrain surface formed on at least one: the fixed sealing frame profile and the seal-less removable frame profile.

4. The dual support connector assembly of claim 1, comprising a shape for the fixed sealing frame profile and the seal-less removable frame profile are selected from the group: rectangle, rectangle with rounded edges, a half round, or a decorative molding shape.

5. The dual support connector assembly of claim 1, comprising a coating layer on the seal-less removable profile, wherein the coating layer consists of a stain, a paint, a sealant, or a primer.

6. The dual support connector assembly of claim 1, comprising a coating layer on the fixed sealing frame profile wherein the coating layer consists of a stain, a paint, a sealant or a primer.

7. The dual support connector assembly of claim 1, comprising wherein the door flange comprises a door flange lip extending at an angle from 80 degrees to 100 degrees from a central axis of the clip body.

8. The dual support connector assembly of claim 1, wherein the glass flange comprises a glass flange lip extending at an angle from 80 degrees to 100 degrees from the central axis of the clip body.

9. The dual support connector assembly of claim 1, wherein the glass panel comprises: a plurality of glass panes.

10. The dual support connector assembly of claim 9, comprising 2 glass panes, separated by a spacer/sealant.

11. The dual support connector assembly of claim 1, wherein the height of the door flange and the height of the glass flange are unequal.

12. The dual support connector assembly of claim 1, wherein the seal-less removable frame comprises:

a. a seal-less removable frame profile with a paint layer;

b. a door contact surface extending from the seal-less removable frame profile;

c. a first side gap surface extending from the door contact surface;

d. a second side gap surface extending from the first side gap surface forming a rigid gap;

e. a first alignment channel engagement member;

f. a first clip surface formed on the first alignment channel engagement member, g. a second alignment channel engagement member in parallel with the first alignment channel engagement member creating a second alignment cavity;

h. a second clip surface formed on the second alignment channel engagement member;

i. a third side gap surface extending from the second clip surface;

j. a rigid gap formed between the second alignment channel engagement member and a fifth side gap surface;

k. a first glass contact surface; and l. a second glass contact surface formed in parallel to the first glass contact surface with the second glass contact surface engaging the seal-less removable frame profile.

* * * * *